United States Patent [19]

Choi et al.

[11] Patent Number: 4,892,644

[45] Date of Patent: Jan. 9, 1990

[54] UPGRADING SOLVENT EXTRACTS BY DOUBLE DECANTATION AND USE OF PSEUDO EXTRACT AS HYDROGEN DONOR

[75] Inventors: Byung Choi, Cherry Hill; Grant G. Karsner, Voorhees Township, Camden County; Chang-Kuei Lee, Sewell; Madhava Malladi, West Deptford, all of N.J.; Donald Milstein, Yardley, Pa.

[73] Assignee: Mobil Oil Corporation, New York, N.Y.

[21] Appl. No.: 256,095

[22] Filed: Oct. 7, 1988

Related U.S. Application Data

[63] Continuation of Ser. No. 13,733, Feb. 12, 1987, abandoned, which is a continuation-in-part of Ser. No. 793,938, Nov. 1, 1985, abandoned.

[51] Int. Cl.[4] ..... C10G 47/32

[52] U.S. Cl. ..... 208/107; 208/56; 208/106; 208/80

[58] Field of Search ..... 208/87, 320, 321, 322, 208/50, 106, 107, 108, 56, 80

[56] References Cited

U.S. PATENT DOCUMENTS

| | | | |
|---|---|---|---|
| 2,087,455 | 7/1937 | Stratford | 208/327 |
| 2,868,716 | 1/1954 | Moyer | 208/87 |
| 3,007,979 | 11/1961 | Peters | 208/320 |
| 3,132,093 | 5/1964 | Arnold et al. | 208/320 |
| 3,205,167 | 9/1965 | Demeester | 208/317 |
| 3,654,137 | 4/1972 | Dober et al. | 208/87 |
| 3,825,489 | 7/1974 | Steinmetz et al. | 208/327 |
| 3,912,618 | 10/1975 | Dryer | 208/327 |
| 4,045,332 | 8/1977 | Forbes et al. | 208/327 |
| 4,304,600 | 12/1981 | Sequeira, Jr. et al. | 208/327 |
| 4,381,234 | 4/1983 | Audeh et al. | 208/327 |
| 4,389,303 | 6/1983 | Simo et al. | 208/107 |
| 4,498,980 | 2/1985 | Forte | 208/321 |
| 4,569,755 | 2/1986 | McGinley et al. | 208/321 |
| 4,571,295 | 2/1986 | Forte | 208/321 |
| 4,594,148 | 6/1986 | Hosler | 208/321 |
| 4,664,783 | 5/1987 | Preusser et al. | 208/321 |

FOREIGN PATENT DOCUMENTS

| | | | |
|---|---|---|---|
| 128047 | 12/1984 | European Pat. Off. | 208/321 |
| 0133774 | 3/1985 | European Pat. Off. . | |
| 0026981 | 3/1981 | Japan | 208/320 |
| 1156838 | 6/1964 | United Kingdom | 208/327 |
| 1993927 | 6/1965 | United Kingdom | 208/321 |

OTHER PUBLICATIONS

"Applying RDC* to Lube Extraction" Petroleum Refiner Sep., 1955, pp. 129–134 by G. H. Reman et al.

*Primary Examiner*—Helane E. Myers
*Attorney, Agent, or Firm*—Alexander J. McKillop; Charles J. Speciale; Malcolm D. Keen

[57] ABSTRACT

A solvent extract obtained from a conventional hydrocarbon oil solvent extraction process, e.g., one employing furfural as the extraction solvent, is cooled to a temperature providing, following a secondary decantation of the cooled extract, a pseudo raffinate containing most of the non-aromatics and a pseudo extract possessing a hydro-aromatic content of $H_{alpha}$ hydrogen of at least 20 percent of the total hydrogen content. The pseudo extract is ideally suited as a hydrogen-donor for a variety of refinery operations such as visbreaking. The pseudo raffinate is suitable as a co-feed for such catalytic cracking operations as fluidized catalytic cracking (FCC) and thermofor catalytic cracking (TCC) and can be recycled to the extraction unit to produce more lube oil.

25 Claims, No Drawings

UPGRADING SOLVENT EXTRACTS BY DOUBLE DECANTATION AND USE OF PSEUDO EXTRACT AS HYDROGEN DONOR

CROSS REFERENCE TO RELATED APPLICATION

This is a continuation of copending application Ser. No. 013,733, filed on Feb. 12, 1987, now abandoned, which is a continuation-in-part of commonly assigned copending U.S. patent application Ser. No. 793,938, filed Nov. 1, 1985 now abandoned.

BACKGROUND OF THE INVENTION

This invention relates to a process for the selective solvent extraction of hydrocarbon mixtures, for example lubricating oils, and in particular, a process for the solvent extraction of lubricating oils using furfural. The invention also relates to the processing of residual petroleum stocks by visbreaking in the presence of certain highly aromatic hydrogen-donor materials obtained from a solvent extraction process such as one employing furfural.

Solvent extraction is a well known process for the separation of aromatic hydrocarbons from mixtures with nonaromatic hydrocarbons of similar boiling range. Furfural has been found to be an excellent selective solvent in the separation of hydrocarbons of relatively high boiling point, for example, hydrocarbons useful in the manufacture of lubricating oils and catalytic cracking feed stocks. Furfural extraction has also been found useful in the manufacture of kerosine and low boiling gas oil products where a raffinate of low aromatic content is produced.

In a typical furfural extraction process, a liquid hydrocarbon mixture containing aromatic and non-aromatic hydrocarbons is contacted with liquid furfural in an extraction column effecting formation of a raffinate phase, which is withdrawn from the top of the column and which contains a major portion of the non-aromatic hydrocarbons, and an extract phase which is withdrawn from the bottom of the column and which contains most of the furfural containing dissolved hydrocarbons including a major portion of the aromatic hydrocarbons and the remaining non-aromatic hydrocarbons. The two phases can then be separated into their constituents by distillation. According to U.S. Pat. No. 3,205,167, it is also known to treat the extract phase by cooling thus separating it into one phase comprising a naphthenic oil known as a pseudo raffinate and containing a little solvent and the other phase comprising the so-called "extract proper" containing the more aromatic and sulfurized components of the oil and a large quantity of solvent. U.S. Pat. No. 3,205,167 is silent regarding the specific temperature range within which this cooling operation is to be carried out and says nothing of the composition or properties of the "extract proper".

Visbreaking, or viscosity breaking, is a well known petroleum refining process in which reduced crudes are pyrolyzed, or cracked, under comparatively mild conditions to provide products having lower viscosities and pour points, thus reducing the amounts of less viscous and more valuable blending oils, so-called "cutter stock", required to make the residual stocks useful as fuel oils. The visbreaker feed stock usually consists of a mixture of two or more refinery streams derived from sources such as atmospheric residuum, vacuum residuum, furfural-extract, propane-deasphalted tar and catalytic cracker bottoms. Most of these feed stock components, except the heavy aromatic oils, behave independently in the visbreaking operation. Consequently, the severity of the operation for a mixed feed is limited greatly by the least desirable (highest coke-forming) components. In a typical visbreaking process, the crude or resin feed is passed through a heater and heated to about 425° to about 525° C. at about 450 to about 7000 kPa. Light gas-oil may be recycled to lower the temperature of the effluent to about 260° to about 370° F. Cracked products from the reaction are flash distilled with the vapor overhead being fractionated into a light distillate overhead product, for example, gasoline and light gas-oil bottoms, and the liquid bottoms are vacuum fractionated into heavy gas-oil distillate and residual tar. Examples of such visbreaking methods are described in Beuther et al., "Thermal Visbreaking of Heavy Residues," *The Oil and Gas Journal*, 57: 46, Nov. 9, 1959, pp. 151–157; Rhoe et al., "Visbreaking: A Flexible Process," *Hydrocarbon Processing*, January 1979, pp. 131–136; and U.S. Pat. No. 4,233,138.

European Patent Application 0 133 774 describes a process for visbreaking a heavy petroleum residual oil which comprises subjecting the oil to an elevated temperature for a period of time corresponding to an equivalent reaction time of 250 to 1500 ERT seconds at 427° C., in the presence of from 0.1 to 50 weight percent, based on the residual oil, of a hydro-aromatic solvent having a content of $H_{Ar}$ hydrogen (protons which are attached directly to aromatic rings and which constitute a measure of aromaticity of a material) and $H_{alpha}$ hydrogen (protons which are attached to non-aromatic carbon atoms themselves attached directly to an aromatic ring, e.g., alkyl groups and naphthenic ring structures) each of at least 20 percent of the total hydrogen content, and recovering a fuel oil product having a viscosity lower than that of the starting residual oil. The hydro-aromatic solvent used in this process is a thermally stable, polycyclic, aromatic/hydroaromatic distillate hydrogen donor material, preferably one which results from one or more petroleum refining operations. The hydrogen-donor solvent nominally has an average boiling point of 200° to 500° C., and a density of 0.85 to 1.1 g/cc. Examples of such suitable hydrogen donor materials are highly aromatic petroleum refinery streams, such as fluidized catalytic cracker "main column" bottoms which are highly preferred, fluidized catalytic cracker "light cycle oil," and thermofor catalytic cracker "syntower" bottoms, all of which contain a substantial proportion of polycyclic aromatic hydrocarbon constituents such as naphthalene, dimethylnaphthalene, anthracene, phenanthrene, fluorene, chrysene, pyrene, perylene, diphenyl, benzothiophene, tetralin and dihydronaphthalene, for example. Such refractory petroleum materials are resistant to conversion to lighter (lower molecular weight) products by conventional non-hydrogenative procedures. Typically, these petroleum refinery residual and recycle fractions are hydrocarbonaceous mixtures having an average carbon to hydrogen ratio above about 1:1, and an average boiling point above 230° C.

SUMMARY OF THE INVENTION

It is an object of the present invention to provide an upgraded solvent extract of a hydrocarbon oil which is suitable as a hydrogen donor.

It is another object of this invention to provide a pseudo raffinate product as a feedstock for catalytic cracking such as fluidized catalytic cracking (FCC) or thermofor catalytic cracking (TCC), or for lube oil production.

It is a still further object of this invention to provide a pseudo extract product of a furfural extraction process which possesses a hydro-aromatic content of $H_{alpha}$ hydrogen of at least 20 percent of the total hydrogen content and to employ this pseudo extract as a hydrogen-donor in a visbreaking process or other process utilizing a hydrogen donor.

In furtherance of the foregoing objects, there is provided a solvent extraction process which comprises:

(a) contacting a liquid hydrocarbon feed containing aromatic and non-aromatic hydrocarbon components with an extraction solvent in an extraction column at elevated temperature to provide a raffinate phase containing the major portion of the non-aromatic components and a minor portion of the extraction solvent and an extract phase containing the major portion of the aromatic hydrocarbon components of the feed and a major portion of the extraction solvent;

(b) cooling the extract phase to separate said phase into a pseudo raffinate containing most of the non-aromatics of the extract phase and a pseudo extract containing most of the aromatic content of the extract phase along with most of the solvent, the magnitude of said cooling being sufficient to provide upon separation of the pseudo raffinate from the pseudo extract in a decanter, a pseudo extract possessing a hydro-aromatic content of $H_{alpha}$ hydrogen of at least 20 percent of the total hydrogen content; and, (c) separating the pseudo raffinate from the pseudo extract in a decanter at said temperature.

The pseudo extract resulting from the foregoing process, referred to herein as a "double decantation" process, is well-suited for use in processes employing a hydrogen-donor, e.g., in the visbreaking process described in aforesaid European Patent Application 0 133 774. The pseudo raffinate is advantageously used as feedstock in otherwise conventional catalytic cracking processes, the operational parameters of which are well known in the art. The pseudo raffinate can also be recycled to the first, or primary, extraction column to produce additional lube stock.

BRIEF DESCRIPTION OF THE DRAWINGS

FIG. 1 is a schematic representation of the solvent extraction process of this invention carried out with the preferred solvent, furfural; and, FIG. 2 is a schematic representation of a visbreaking process employing the pseudo extract obtained in accordance with the present solvent extraction process as a hydrogen-donor.

DESCRIPTION OF THE PREFERRED EMBODIMENTS

As shown in FIG. 1, a liquid hydrocarbon charge stock containing both aromatic and non-aromatic hydrocarbon components, e.g., Arab medium crude, is introduced into an extraction column. While Arab medium crude has been described as a suitable charge stock, it is to be understood that other charge stocks are also suitable. Among the general types of suitable charge stocks are the lighter, i.e., less viscous, stocks. By way of illustration, charge stocks having a viscosity of about 100 Sabol seconds to about 800 Sabol seconds are usually quite suitable. In contrast, high viscosity charge stocks such as bright stock and reduced crude stock are ordinarily unsuitable as feedstocks. The term reduced crude is used by those skilled in the art to designate the bottom product present in a vacuum tower or atmospheric tower. As such, reduced crude is known to contain asphaltenes, the source of sediment. Therefore, if reduced crude were used as a charge stock in the present process, which will be described in detail hereinafter, most of the asphaltenes would settle in the extract phase. This would only impede the production of a high quality H donor.

Also introduced into the extraction column along with the suitable charge stock is a quantity of suitable extraction solvent, in this case the preferred solvent, furfural.

The amount of extraction solvent can vary widely and will frequently range from about 100 to about 300 volume percent of the charge stock. The extraction process of this invention contemplates the use of a conventional solvent extraction unit operated under conventional conditions. For example, in a typical lube oil facility, the extraction column is operated within a predetermined temperature profile so as to provide a raffinate phase which, following dewaxing, will provide a lube oil product meeting specifications taking into account the properties of the charge stock. The extraction column is commonly operated at about 150° to about 300° F., and preferably 180° to about 250° F., at the bottom, the temperature at the top of the column being some 20° to 60° F., and preferably from about 30° to about 50° F., higher than this. Such a temperature profile is entirely suitable for practicing the extraction process of this invention. Under these conditions, the extract phase will usually contain a relatively minor amount of non-aromatic components, e.g., from about 10 to 25 weight percent of the non-aromatic content of the original feed. Although more of these non-aromatics can be shifted to the raffinate phase by lowering the bottom temperature of the extraction unit, this may be achieved at the expense of lube stock quality. Of course, where lube stock quality is not a compelling consideration, the extraction column can be operated within a temperature profile different from that aforestated.

Following its withdrawal from the bottom of the furfural extractor, the extract phase is passed through a heat exchanger where it is cooled to a temperature resulting in the separation of the stream into a pseudo raffinate containing most of the non-aromatics and a pseudo extract containing most of the aromatic components. The greater the magnitude of cooling, the more aromatics will be shifted to the pseudo extract. Such cooling must, at a minimum, be sufficient to provide a pseudo extract possessing a hydro-aromatic content of $H_{alpha}$ hydrogen of at least about 20 percent, and preferably up to about 50 percent, based on total hydrogen content. In general, cooling the extract phase to a temperature of from about 90° to about 160° F., and preferably from about 100° to about 120° F., is sufficient to provide such a pseudo extract. The cooled two-phase stream is then separated in a decanter to provide the aforesaid pseudo extract which, after removal of furfural (or other extraction solvent as the case might be), e.g., by distillation, is ready to be employed as a hydrogen-donor.

The pseudo raffinate resulting from the foregoing double decantation process with its enriched non-aromatic hydrocarbon content is advantageously employed as co-feed in a catalytic cracking operation, e.g., an FCC or TCC process. Alternatively, the pseudo raffinate can be recycled to the initial extraction unit to produce more lube oil.

The use of the foregoing pseudo extract as a hydrogen-donor in visbreaking is advantageously carried out in a facility of the type shown schematically in FIG. 2 in which a viscous hydrocarbon oil feed, typified by a 496° C.+ Arab Heavy resid, is supplied by line 22 to visbreaking heater 25. The feed is blended with the pseudo extract as the hydrogen-donor material supplied through line 50 in an amount of 0.1 to 50 weight percent, preferably 0.1 to 20 weight percent, based on the resid charge, (a weight ratio of hydrogen-donor to resid of 0.001 to 0.5, preferably 0.001 to 0.2). Mild thermal cracking of the resid under visbreaking conditions occurs in visbreaker 25 and produces a visbreaker effluent stream carried by line 28.

Visbreaking process conditions can vary widely based on the nature of the heavy oil material, the hydrogen-donor pseudo extract and other factors. In general, the process is carried out at temperatures ranging from 350° to 485° C., preferably 425° to 455° C., at residence times ranging from 1 to 60 minutes, preferably 7 to 20 minutes. The expression "Equivalent Reaction Time", also referred to as "ERT", refers to the severity of the visbreaking operation expressed as seconds of residence time in a reactor operating at 427° C. In very general terms, the reaction rate doubles for every 12° to 13° C. increase in temperature. Thus 50 seconds of residency time at 427° is equivalent to 50 ERT, and increasing the temperature to 456° C. would make the operation five times as severe, e.g., 300 ERT. Expressed as ERT, the visbreaking process herein operates at an Equivalent Reaction Time of 250 to 1500 ERT seconds, and preferably 400 to 1200 ERT seconds and more preferably 500 to 800 ERT seconds, at 427° C. The pressure employed in the visbreaker will usually be sufficient to maintain most of the material in the reactor coil and/or soaker drum in the liquid phase. Normally the pressure is not considered as a control variable, although attempts are made to keep the pressure high enough to maintain most of the material in the visbreaker in the liquid phase. Some vapor formation in the visbreaker is not harmful, and is frequently inevitable because of the production of some light ends in the visbreaking process. Some visbreaker units operate with 20–40 percent vaporization material at the visbreaker coil outlet. Lighter solvent will vaporize more and the vapor will not do much good towards improving the cracking of the liquid phase material. Accordingly, liquid phase operation is preferred, but significant amounts of vaporization can be tolerated. The pressures commonly encountered in visbreakers range from 170 to 10450 kPa, with a vast majority of units operating with pressures of 1480 to 7000 kPa. Such pressures will usually be sufficient to maintain liquid phase conditions and the desired degree of conversion.

The visbreaker effluent stream carried by line 28 is cooled by admixture with a quench stream from line 31, and the visbreaker effluent continues through line 29 to distillation column 30 where it is fractionated to obtain $C_5$—gases ($C_3$, $C_4$ and lower) and a $C_5$—135° C. naphtha fraction from the top through line 34. A 220°–370° C. gas oil fraction is taken off as a bottoms stream through line 33 where portions may be recycled as a quench stream through line 31, recovered as heavy fuel oil 32 or, via line 33, blended with cutter stock to meet fuel oil product specifications.

The overhead fraction removed from the distillation column in line 34 is passed through a cooler separator 36 which is operated under conditions effective to separate the incoming liquid into a $C_5$—off-gas stream 38, mainly $C_3$ or $C_4$ and lower, and a $C_5$—135° C. naphtha fraction which is taken off via line 40. Because of the boiling range and quality of the hydrogen-donor, it can simply be allowed to remain with the bottom fraction and used directly as heavy fuel oil, thus avoiding the need for separation.

The use of said pseudo extract as hydrogen-donor in visbreaking is not limited to the foregoing visbreaker/-distillation agreement. Any visbreaker scheme can be used, ranging from a tubular reactor which is entirely in the heater, to a soaking drum reactor wherein most of the visbreaking reaction occurs in the soaking drum. Any combination of the two processes can also be used, e.g., much of the visbreaking reaction can be accomplished in a coil while the remainder of the visbreaking can be made to occur in a soaking drum down-stream of the coil. Similarly, any distillation scheme known in the art can be used to process the visbreaker reactor effluent. In conventional visbreaking operations, it is preferred to quench the visbreaker effluent with a quench stream as shown in the drawing, but it is also possible to use heat exchange, fin fan coolers, or some other conventional means of cooling the visbreaker effluent. However, since there is a risk of coking up the heat exchanger tubes in such an arrangement, use of a quench stream is preferred.

The following examples illustrate the $H_{alpha}$ content of the pseudo extract attained in accordance with the present invention.

Example 1, the results of which appear in TABLE I, illustrates that the attainment of the desired $H_{alpha}$ content is highly charge stock dependent.

Examples 2–5, the results of which appear in TABLE II illustrates the desired $H_{alpha}$ content being attained in accordance with the present invention when appropriate charge stocks are employed.

Example 6 illustrates the use of pseudo extract as a hydrogen donor in visbreaking and Example 7 illustrates the use of pseudo raffinate in a thermofor catalytic cracking operation.

EXAMPLE 1

In the data set forth in TABLE I below, the conditions of operation of the decantation of the base extract phase recovered from the decantation of a suitable charge stock (100N) and an inappropriate charge stock (Bright Stock) are given. The properties of the resulting pseudo raffinate and pseudo extract are also given:

TABLE I

DECANTATION OF BASE EXTRACT PHASE

| EXAMPLE<br>Charge Stock | 1<br>100 N | COMPARISON EXAMPLE 1<br>Bright Stock |
|---|---|---|
| Double Decantation Conditions | | |
| Temperature, °F. | 122° F. | 122° F. |
| Solvent Dosage, Vol. % | 240 | 240 |
| Pseudo Raffinate, Vol. % | 38.3 | 88.9 |
| Pseudo Extract, Vol. % | 61.7 | 11.1 |
| Pseudo Raffinate Properties | | |
| API | 20 | 14.8 |

TABLE I-continued

| DECANTATION OF BASE EXTRACT PHASE | | |
|---|---|---|
| EXAMPLE | 1 | COMPARISON EXAMPLE 1 |
| Charge Stock | 100 N | Bright Stock |
| Sulfur, Wt. % | 3.6 | 4.21 |
| Total N, Wt. % | 400 | 900 |
| RI at 70° C. | 1.501 | 1.5203 |
| CCR, Wt. % | 0.01 | 3.33 |
| Aromatics, Wt. % | 6 | 8 |
| Pseudo Extract Properties | | |
| API | 8.2 | 3.1 |
| RI at 70° C. | 1.5570 | 1.6050 |
| $H_{alpha}$, Wt. % | 22 | 9 |

As these data show, double decantation of a bright stock yields a pseudo extract having a lower $H_{alpha}$ value than the $H_{alpha}$ value recognized from the double decantation of a suitable charge stock.

EXAMPLES 2–5

In the data set forth in TABLE II below, the conditions of operation of the decantation of the base extract phase recovered from the decantation of preferred charge stocks are given. The properties of the resulting pseudo raffinate and pseudo extract are also given.

TABLE II

| DECANTATION OF BASE EXTRACT PHASE | | | | |
|---|---|---|---|---|
| EXAMPLE | 2 | 3 | 4 | 5 |
| Charge Stock | 100 A | 100 T | 300 A | 700 A |
| Double Decantation Conditions | | | | |
| Temperature, °F. | 120 | 100 | 100 | 140 |
| Solvent Dosage, Vol. % | 350 | 350 | 400 | 450 |
| Pseudo Raffinate, Vol. % | 29.5 | 45.9 | 44.5 | 23.9 |
| Pseudo Extract, Vol. % | 70.5 | 54.1 | 55.5 | 76.1 |
| Pseudo Raffinate Properties | | | | |
| API | 25.2 | 25.7 | 19.4 | 16.5 |
| Sulfur, Wt. % | 2.19 | 1.95 | 2.94 | 3.24 |
| Total N, Wt. % | 140 | 120 | 340 | 900 |
| RI at 70° C. | 1.4827 | 1.4807 | 1.5018 | 1.5148 |
| CCR, Wt. % | <0.01 | <0.01 | 0.12 | 1.04 |
| Aromatics, Wt. % | 3 | 3 | 66.8 | 3 |
| Pseudo Extract Properties | | | | |
| API | 8.7 | 7 | 4.1 | 3 |
| RI at 70° C. | 1.5540 | 1.5608 | 1.5780 | 1.5840 |
| $H_{alpha}$, Wt. % | 24 | 26 | 24 | 23 |

As these data show, the double decantation of a suitable charge stock result in a pseudo extract having an $H_{alpha}$ content of at least 20%.

EXAMPLE 6

Visbreaking was carried out upon an Arab Heavy Resid base stock (1075° F.+) both with and without the pseudo extract of Example 1 as hydrogen donor. Use of the pseudo extract permitted the visbreaking unit to be operated under more severe conditions as expressed in terms of "equivalent reaction time" (ERT), as explained above. The operating conditions and the results of visbreaking were as follows:

TABLE III

| | Visbreaking Conditions and Product Stream | | |
|---|---|---|---|
| Feed Rate (Barrels/Day) | Base Stock (without pseudo extract) | Base Stock (with added pseudo extract) | |
| Base Stock | 23000 | 23000 | |
| Pseudo Extract (Example 1) | — | 2500 | |
| Visbreaking Conditions | | | |
| Inlet Pressure, psig | 600 | 600 | |
| Outlet Pressure, psig | 400–450 | 400–450 | |
| Reactor Temp., °F. | 850 | 850 | |
| Residence Time, seconds | 130 | 150 | |
| Equivalent Reaction Time | 700 | 800 | |
| Visbreaking Products Stream (Barrels/Day) | | | Difference |
| Gasoline | 3120 | 3310 | +190 |
| Distillate | 530 | 1760 | +1230 |
| External Cutter Stock (required to meet heavy fuel oil specifications) | 14280 | 9140 | −5140 |

As these data indicate, the more severe visbreaker conditions made possible by the addition of pseudo extract as a hydrogen donor resulted in greater yields of gasoline and distillate and a sharp reduction in the amount of cutter stock required to provide a heavy fuel oil (HFO) meeting specifications.

EXAMPLE 7

Thermofor catalytic cracking was carried out upon a virgin gas oil (VGO) both with and without the addition of the pseudo raffinate of Example 2. The reactor conditions and results were as follows:

TABLE IV

| | Thermofor Catalytic Cracking and Product Stream | | |
|---|---|---|---|
| Feed Rate (Barrels/Day) | VGO without pseudo raffinate | VGO with pseudo raffinate | |
| VGO | 16700 | 16700 | |
| Psuedo Raffinate, Example 2 | — | 2500 | |
| Reactor Conditions | | | |
| Catalyst Circulation Rate, ton/hr. | 660 | 660 | |
| Catalyst/Oil, wt. ratio | 3.59 | 4.24 | |
| LHSV | 3.03 | 2.61 | |
| Reactor Temperature, °F. | 911 | 925 | |
| Catalyst Activity | 47.5 | 47.5 | |
| Product Stream (Barrels/Day) | | | Difference |
| Gasoline | 9035 | 9870 | +835 |
| Distillate | 3023 | 3398 | +375 |
| Heavy Fuel Oil | 752 | 2197 | +1445 |

The significant advantages resulting from the use of pseudo raffinate obtained in accordance with the present invention in a TCC operation is apparent from these data. The increase in operation severity made possible by the use of pseudo raffinate resulted in greater levels of production of gasoline, distillate and heavy fuel oil.

What is claimed is:

1. A process for visbreaking a heavy petroleum residual oil which comprises subjecting the residual oil to an elevated temperature for a period of time corresponding to an equivalent reaction time of about 250 to about 1500 ERT seconds at 427° C., to produce a fuel oil product having a viscosity lower than that of the starting residual oil, the residual oil being subjected to the elevated temperature in the presence of from about 0.1 to about 50 weight percent, based on the residual oil, of a hydroaromatic solvent having a content of $H_{alpha}$ hydrogen of at least about 20 percent of the total hydrogen content, said hydroaromatic solvent being provided as a pseudo extract from a solvent extraction process in which a liquid hydrocarbon feed containing aromatic and non-aromatic hydrocarbon components is extracted with an extraction solvent to provide a raffinate phase containing a major portion of the non-aromatic components and an extract phase containing the major portion of the aromatic hydrocarbon components of the feed, cooling the extract phase to separate it into a pseudo raffinate containing most of the non-aromatics of the extract phase and a pseudo extract containing most of the aromatic content of the extract phase, and separating the pseudo raffinate from the pseudo extract.

2. A process according to claim 1 wherein visbreaking is carried out at about 400 to about 1200 ERT seconds.

3. A process according to claim 2 wherein visbreaking is carried out at about 500 to about 800 ERT seconds.

4. A process according to claim 1 wherein visbreaking is carried out at about 350° to about 485° C. for about 1 to about 60 minutes.

5. A process according to claim 4 wherein visbreaking is carried out at about 425° to about 455° C.

6. A process according to claim 4 wherein visbreaking is carried out for about 7 to about 20 minutes.

7. A process according to claim 1 wherein visbreaking is carried out in the presence of about 0.1 to about 20 weight percent, based on the residual oil, of the hydroaromatic solvent.

8. A process according to claim 7 wherein the amount of hydroaromatic solvent is about 10 to about 20 weight percent.

9. A process according to claim 1 in which the hydroaromatic solvent has an aromatic proton content $H_{Ar}$ of at least 20 percent of the total hydrogen content of the solvent.

10. A process according to claim 1 in which the hydroaromatic solvent has an aromatic proton content $H_{Ar}$ and an $H_{alpha}$ content each of 20 to 50 percent of the total hydrogen content of the solvent.

11. A process for producing a fuel product from residual oil of higher viscosity, which comprises the steps of:

(i) contacting a liquid hydrocarbon feed containing aromatic and non-aromatic hydrocarbon components with an extraction solvent to provide a raffinate phase containing the major portion of the non-aromatic components and an extract phase containing the major portion of the aromatic hydrocarbon components of the feed, (ii) cooling the extract phase to separate it into a pseudo raffinate containing most of the non-aromatics of the extract phase and a pseudo extract containing most of the aromatic content of the extract phase and a hydroaromatic content of $H_{alpha}$ hydrogen of at least 20 percent of the total hydrogen content;

(iii) separating the pseudo raffinate from the pseudo extract in a decanter, and (iv) visbreaking the residual oil in the presence of 0.1 to 50 weight percent of the separated pseudo extract as an H-donor, for a period of time corresponding to an equivalent reaction temperature of 250 to about 1500 ERT seconds at 427° C.

12. A process according to claim 11 wherein visbreaking is carried out at about 400 to about 1200 ERT seconds.

13. A process according to claim 12 wherein visbreaking is carried out at about 500 to about 800 ERT seconds.

14. A process according to claim 11 wherein visbreaking is carried out at about 350° to about 485° C. for about 1 to about 60 minutes.

15. A process according to claim 14 wherein visbreaking is carried out at about 425° to about 455° C.

16. A process according to claim 14 wherein visbreaking is carried out for about 7 to about 20 minutes.

17. A process according to claim 11 wherein visbreaking is carried out in the presence of about 0.1 to about 20 weight percent, based on the residual oil, of the hydro-aromatic solvent.

18. A process according to claim 17 wherein the amount of hydroaromatic solvent is about 10 to about 20 weight percent.

19. A process according to claim 11 in which the hydroaromatic solvent has an aromatic proton content $H_{Ar}$ of at least 20 percent of the total hydrogen content of the solvent.

20. A process according to claim 11 in which the hydroaromatic solvent has an aromatic proton content $H_{Ar}$ and an $H_{alpha}$ content each of 20 to 50 percent of the total hydrogen content of the solvent.

21. A process according to claim 11 which includes the step of:

(v) catalytically cracking the pseudo-raffinate separated from the pseudo-extract.

22. A process according to claim 9 which includes the step of:

catalytically cracking the pseudo-raffinate separated from the pseudo-extract.

23. A process according to claim 10 which includes the step of:

catalytically cracking the pseudo-raffinate separated from the pseudo-extract.

24. A process according to claim 11 which includes the step of recycling the pseudo-raffinate separated from the pseudo-extract to step (i) for further extraction with the solvent.

25. A process according to claim 10 in which the solvent comprises furfural.

* * * * *